US005485386A

United States Patent [19]

Andreasson

[11] Patent Number: 5,485,386

[45] Date of Patent: Jan. 16, 1996

[54] METHOD AND DEVICE FOR THE CONTROL AND REGULATION OF THE STRETCH OF A RUNNING WEB

[76] Inventor: Bengt Andreasson, Mörtebolsgatan 15, S-662 00 Åmål, Sweden

[21] Appl. No.: 74,859

[22] PCT Filed: Dec. 11, 1991

[86] PCT No.: PCT/SE91/00849

§ 371 Date: Jun. 10, 1993

§ 102(e) Date: Jun. 10, 1993

[87] PCT Pub. No.: WO92/10419

PCT Pub. Date: Jun. 25, 1992

[30] Foreign Application Priority Data

Dec. 12, 1990 [SE] Sweden ..... 9003961

[51] Int. Cl.[6] ..... B65H 23/00

[52] U.S. Cl. ..... 364/471; 326/42; 326/44

[58] Field of Search ..... 364/469, 472, 364/471; 72/8, 9, 10, 11, 12; 242/420.5, 412.2, 421.1, 421.4, 421.7; 226/42, 44

[56] References Cited

U.S. PATENT DOCUMENTS

| | | | |
|---|---|---|---|
| 3,574,280 | 4/1971 | Smith | 364/472 X |
| 3,674,221 | 7/1972 | Riemersma | 242/75.51 |
| 4,236,216 | 11/1980 | Anbe | 364/472 |
| 4,244,025 | 1/1981 | Alshuk | 364/472 |
| 4,292,825 | 10/1981 | Morooka et al. | 72/8 |
| 4,323,971 | 4/1982 | Möltner | 364/469 |
| 4,729,520 | 3/1988 | Katoaka | 242/56.2 |
| 4,747,063 | 5/1988 | Kuramoto | 364/472 X |
| 4,760,723 | 8/1988 | Nakagawa | 364/472 X |
| 4,860,212 | 8/1989 | Uesugi | 364/472 |

FOREIGN PATENT DOCUMENTS

| | | |
|---|---|---|
| 1484185 | 9/1977 | United Kingdom . |
| 2075074 | 11/1981 | United Kingdom . |
| 2078208 | 1/1982 | United Kingdom . |

*Primary Examiner*—Roy N. Envall, Jr.
*Assistant Examiner*—Brian C. Oakes
*Attorney, Agent, or Firm*—Griffin, Butler, Whisenhunt & Kurtossy

[57] ABSTRACT

A method and an apparatus provided to calculate and control the elongation in a running web (16), e.g. in connection with a preparation of a web in a printing machine. In connection with at least an increase or decrease in the web tension, the length change in a reference length of the web material is measured, and by means of web tension meters the web tension before and after the web tension change ($\sigma_1$–$\sigma_2$) or each one of the web tension alterations is determined. The tension-free length ($n_o$) of the reference length is also calculated and if it is needed, the elongation of the web is corrected through an increase or a decrease in the web tension depending on said measurements.

9 Claims, 2 Drawing Sheets

METHOD AND DEVICE FOR THE CONTROL AND REGULATION OF THE STRETCH OF A RUNNING WEB

TECHNICAL FIELD

A method of calculating and controlling the elongation of a running web, e.g. a web in connection with the preparation of a web in a printing unit and a device for the carrying out of the method.

BACKGROUND ART

In order to obtain a product having a satisfactory quality in the processing of web materials, e.g. in connection with printing, a high accuracy is required as regards an accurate positioning, when the web material is fed into processing machines. When it is the matter of printing, the processing machines can be printing machines.

When the material is fed between rolls, it generally is pretensioned and stretched, which results in a varying length in connection with variations in e.g. web tension and coefficient of elasticity. The elongation of the web material varies with web width, web thickness, moisture, material quality etc. A high product quality requires knowledge of the elongation of the web material in various processing phases and particularly in critical processing phases.

An example of this is the printing on a running paper web, and it is important that the print on forms obtains a predetermined length after the printing. This is particularly important in connection with the preparation of multi-sheet sets, which comprise a plurality of assembled forms, designed e.g. for the simultaneous typing of invoices, shipping notes, order confirmations, etc. Also, in case these multi-sheet sets of assembled forms shall be printed in a remaliner-fed printer, the hole punching for the remaliner-feeding must have an accurate distance between the holes in accordance with the length of the forms. It is difficult to keep the correct length on printed web materials and this is often evident in multi-sheet sets of assembled forms, designed for remaliner-feeding. In these sets some sheets are often stretched and some are wavy, since they are "extended" (in comparison with the rest of the sheets). The sets of assembled forms in this way become unneccesarily thick with air inclusions around the wavy sheets.

BRIEF DISCLOSURE OF THE INVENTION

The object of the invention is to suggest a method and a device, which allow a continuous control and regulation of the elongation of a running moving web material. This object and other goals are achieved according to the method of the invention, which is characterized in that the length change of the web is measured in connection with at least an increase or decrease in the web tension, in that the web tension is measured either before or after the changing of the web tension or after each one of the changing of the web tension and in that the elongation is determined and if it is required corrected through an increase or a decrease in the web tension depending on said length change and web tension measurements.

The changing of the web tension can be done by means of a roll, which accelerates or decelerates the web to a higher or lower web tension than the original one. The web tension can be measured in a way known per se by means of load cells or any other type of web tension meters. The length change can be determined by knowing the web speed of the accelerated or decelerated part of the web and the web speed in that part of the web, which is not influenced by the changing of web tension. The web speed can be measured by counting pulses generated by a roll in contact with that part of the web, which is subjected to a tension change, and by a roll in contact with that part of the web which is not subjected to the tension change.

The braking or acceleration roll can be controlled by a computer, which with constant intervals or by commands carries out a measuring sequence for the determination of the elongation of the web. The computer then receives measuring data from e.g. two pulse generators, provided to determine the web speed, as well as data from the web tension meter. Also, in case the computer is connected to control a tension regulation device, the computer can calculate the required corrections and correct the present tension level in order to allow the true tension of the web to be the same as the desired tension of the web. Subsequently, the set tension and/or elongation can be continuously controlled through a tension measurement and/or a pulse counting, respectively.

BRIEF DESCRIPTION OF DRAWINGS

In the following description, reference will be made to the following drawings, in which.

DESCRIPTION OF PREFERRED EMBODIMENT

Figure 1:
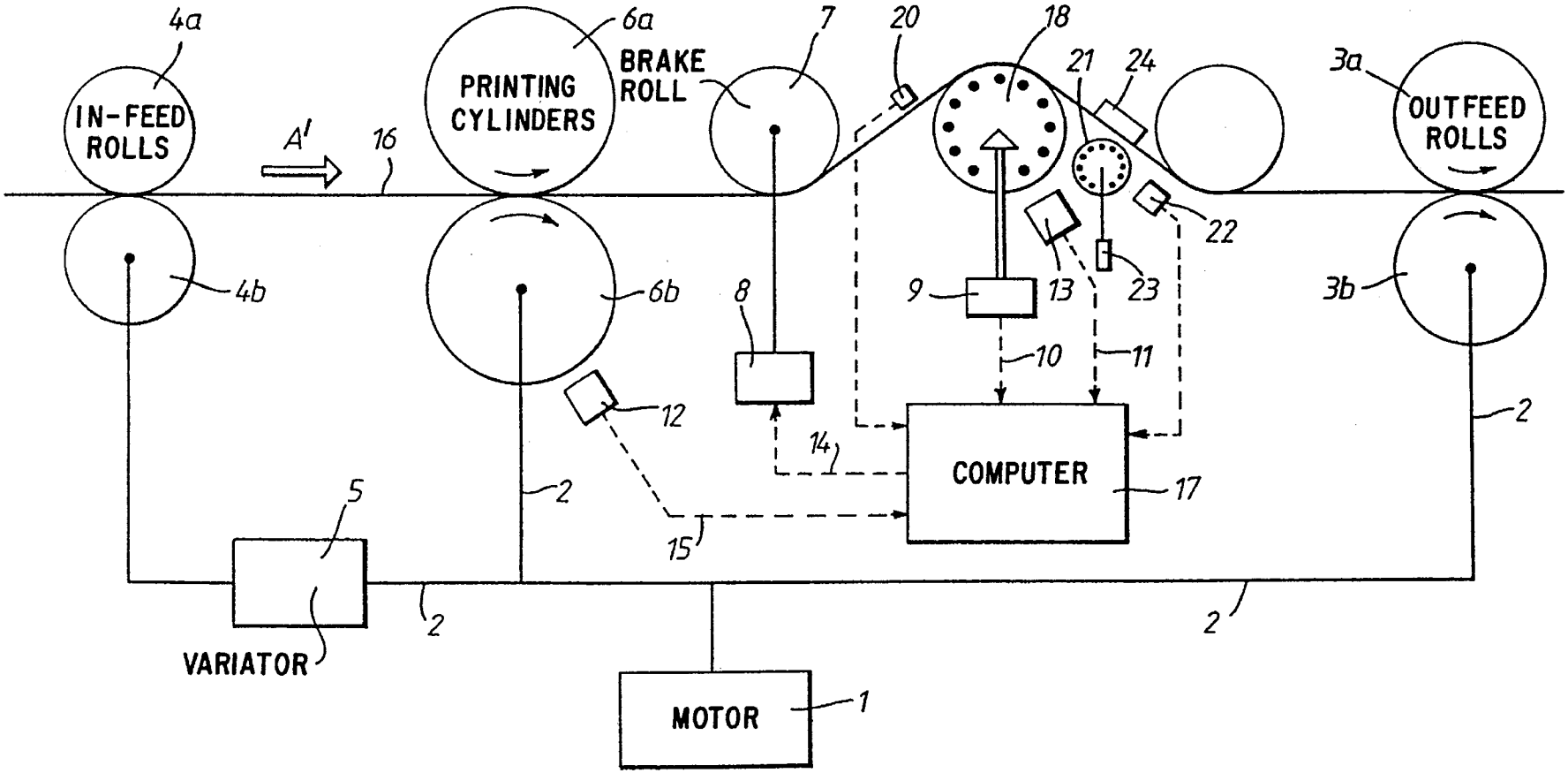
FIG. 1 schematically shows an apparatus for the carrying out of the method according to the present invention.

FIG. 1 shows a paper web in a printing machine, which is equipped with an apparatus for the carrying out of the method according to the invention. The printing machine comprises a printing unit with two printing and support cylinders 6*a*, 6*b*, respectively, and a tensioning unit with two infeed rolls 4*a*, 4*b*, which are controlled by a variator 5.

Variator 5 is connected to a common drive 2 for the printing unit with printing cylinders 6*a*, 6*b* and outfeed rolls 3*a*, 3*b*. By means of variator 5 the peripherical speed of tensioning infeed rolls 4*a*, 4*b* can be changed in relation to the peripherical speed of printing cylinders 6*a*, 6*b* and outfeed rolls 3*a*, 3*b*, which are driven by common drive 2 by means of motor 1. A reduction of the speed of tensioning rolls 4*a*, 4*b* at an unchanged speed of printing cylinders 6*a*, 6*b* and outfeed rolls 3*a*, 3*b* results in an increase in the web tension downstreams of the tensioning device, and an increase in the speed of tensioning rolls 4*a*, 4*b* results in a decrease in the web tension downstreams of the tensioning device.

The device according to the invention comprises a pulse generator 12, which generates one or several pulses for each cylinder revolution, when printing cylinder 6*b* revolves. Via a communication line 15 a pulse or several pulses for each revolution of printing cylinders 6*a*, 6*b* is sent to a computer 17.

Also, the device according to the invention comprises a brake or acceleration roll 7, which is connected to a motor 8, which is controlled by computer 17 and thus is connected to computer 17 via a control line 14. The assembly according to the invention also comprises a measuring roll 18 with a pulse generator 13, the pulses of which are transmitted to computer 17 via a communication line 11. Measuring roll 18 actuates a web tension meter 9, which via a communication line 10 transmits web tension data to computer 17.

In order to remedy faults in measuring roll 18, e.g. due to ink coating and various creeps in the material on the measuring roll, an additional measuring wheel 21 is also used, which is only used to test the elasticity of the web material. Measuring wheel 21 is connected to a pulse generator 22, which sends measurement test results to computer 17 in order to calibrate measuring roll 18. In order to let measuring roll 21 bear on running web 16, which is fully straight within this area, a driving element 23, e.g. an air cylinder, is used. A holding element 24 is also used.

The apparatus operates in the following way. When computer 17 receives a command to initiate a measuring sequence, the present web tension is first stored in the memory, the web tension being obtained from web tension meter 9 via line 10. In the memory of computer 17 the number of pulses $n_1$ is also recorded, which are received from pulse generator 13, during the time between the first and the last pulse of a number of pulses, e.g. $N_o$ pulses, from pulse generator 12. Thus, a measure of the web travel length is obtained, which at the present web tension $\sigma_1$ passes roll 18 during said time, between the first and the last of $N_o$ pulses from pulse generator 12.

Then the web is accelerated via roll 7, which by means of motor 8 is influenced by a moment, which can be pre-set or be selected by the computer program or by the machine operator. In this way the peripherical speed of roll 7 is increased and simultaneously the web tension decreases between roll 7 and outfeed rolls **3*a*, 3*b*. In computer 17, new web tension $\sigma_2$ is recorded, which is transmitted by web tension meter 9, as well as the number of pulses $n_2$ from pulse generator 13 during the time for $N_o$ pulses from pulse generator 12**.

Figure 2:
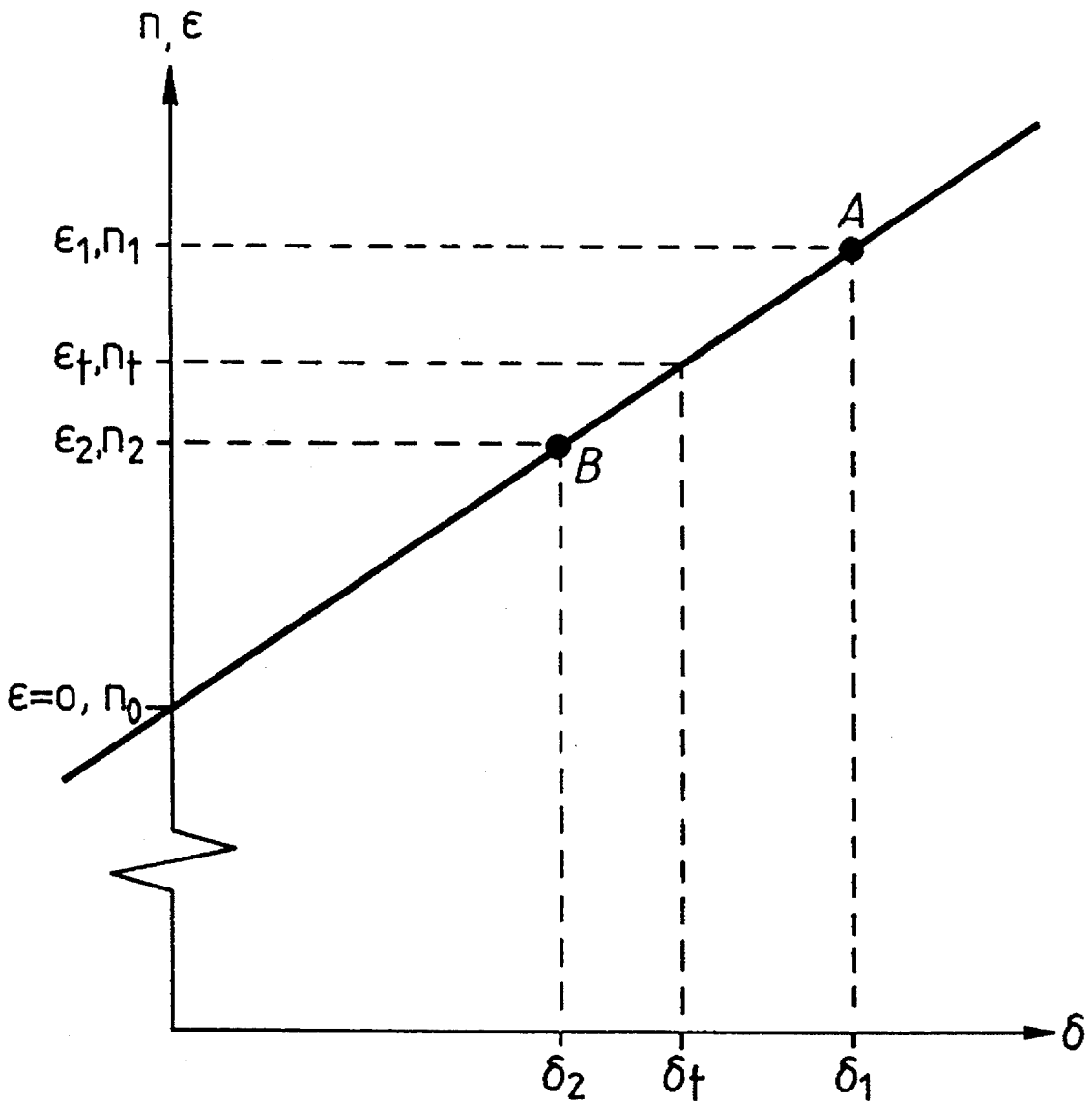
FIG. 2 shows a diagram, which indicates a linear correlation between tension and elongation in a web material.

Due to the reduced stretching, the length of the web material decreases, which passes via roll 18 during the time between the first and the last of $N_o$ pulses from pulse generator 12 and consequently the number of pulses from pulse generator 13 during this time decreases as compared to the measurement, which was done prior to the speed increase of roll 7. The difference $(n_1-n_2)$ between the numbers of pulses $n_1$ and $n_2$ is a measure of the shortening of the web material in connection with the tension reduction. If it is assumed that there is a linear correlation between the tension and the elongation of the web material (which as regards paper materials often is the case at low tension levels), the elongation of the web material can be calculated. FIG. 2 shows how the correlation between tension $\sigma$ and elongation $\epsilon$ of the web material can be estimated graphically, provided that the length change is known, which is obtained through a reduction ($\sigma_1$ to $\sigma_2$). Since the values of $\sigma_1$ and $\sigma_2$ are known, it is e.g. possible to select point A arbitrarily, B being placed at a vertical distance from A, which corresponds to the length change $(n_1-n_2)$ of the web material. Position $n_o$ on pulse number scale corresponds to a tension-free length of the web material. This position is obtained by drawing a line through points A and B, which line crosses the pulse number scale at $n_o$. Also, pulse number $n_o$ can be calculated according to any of the formulas:

$$n_o=n_2-(n_1-n_2)*\sigma_2/(\sigma_1-\sigma_2)$$

$$n_o=n_1-(n_1-n_2)*\sigma_1/(\sigma_1-\sigma_2)$$

When the tension is $\sigma_1$, the elongation of the web material is $\epsilon_1=n_1/n_o-1$ and when the tension is $\sigma_2$, the elongation is $\epsilon_2=n_2/n_o-1$. The coefficient of elasticity of the material can be calculated according to the formula:

$$E=(n_2*(\sigma_1-\sigma_2)-\sigma_2*(n_1-n_2))/(n_1-n_2)$$

Printing cylinders are prepared to obtain the correct printing length for a certain elongation $\epsilon_t$ (in the longitudinal direction of the web). In order to obtain the correct printing length when the web material is tension-free, the web tension must be $\sigma_t$, which results in elongation $\epsilon_t$. Web tension $\sigma_t$ is adjusted by means of variator 5.

The tension required to obtain elongation $\epsilon_t$ can be calculated directly using the formula:

$$\sigma_t=E*\epsilon_t=\epsilon_t*(n_2*(\sigma_1-\sigma_2)-\sigma_2*(n_1-n_2))/(n_1-n_2).$$

When the accurate tension $\sigma_t$ has been set, the elongation can be controlled. The number of pulses, which are emitted by pulse generator 13 during the time for $N_o$ pulses from pulse generator 12, must be $n_t=n_o(1+\epsilon_t)$, when the tension is $\sigma_t$.

This control can subsequently be carried out continuously during the printing of the entire web material. In this connection normally no tension change is needed. The controls which are needed are tension and/or elongation measurements. As regards the used web material, the tension measurement is to show tension $\sigma_t$ and for the "elongation measurement", using pulse counting, the number of pulses, which are generated by pulse generator 13 during the time for $N_o$ pulses from pulse generator 12, is to be $n_t$. Provided a possible tension change $d\sigma$ simultaneously results in an elongation change $d\epsilon=d\sigma/E$, the tension can be corrected. In case the requirement $d\sigma=E*d\epsilon$ is not met, the coefficient of elasticity of the material has been altered, e.g. due to moisture, and then E must be calculated again. The requirement $d\sigma=E*d\epsilon$ may be replaced with the requirement $d\sigma=dn*E/n_o$, in which dn is the deviation of the measured pulse number (the number of pulses which are generated by pulse generator 13 during the time for $N_o$ pulses from pulse generator 12) from pulse number $n_t$.

In the embodiment described above a reference length has been determined by calculating the time for $N_o$ pulses from pulse generator 12, which time corresponds to a certain angular rotation of cylinder **6*a*** (e.g. one or several turns or parts of a turn) and the corresponding web length.

Instead of using pulse generator 12, roll **6*a* can be used to leave a position mark (a printing mark) on the web material per each turn of cylinder 6*a*. By means of a photoelectric cell 20 or the like, which preferably is placed close to measuring roll 18, a signal then can be sent for every passage of a mark. These signals can be transmitted to the computer. Instead of the time interval for $N_o$ pulses from pulse generator 12 it is then possible, in connection with elongation measurements, instead to count pulses, from pulse generator 13 during the time for e.g. $N_o$ signals ($N_o$ printing marks), which are obtained via a photoelectric cell or the like. Pulse generator 12** will then be superfluous.

The apparatus according to the present invention can be positioned anywhere along the web between tensioning infeed rolls **4*a*, 4*b* and out feed rolls 3*a*, 3*b*. It is true that these rolls 4*a*, 4*b*, 3*a*, 3*b* also can be used as acceleration and/or retardation rolls according to the inventive idea. However, usually this is less suitable due to e.g. the inertial moment of the rolls. It is true that only one roll is needed, which can be braked or be repositioned, or another device (a metal foil web possibly can be heated), designed to obtain a controlled and controllable change of web tension. Also, it is not necessary to position measuring roll 18 downstreams of brake or acceleration roll 7. In the measuring sequence described above the web material has been accelerated via roll 7. However, the material can also be braked via roll 7** and in this way a tension increase can be introduced, utilized to determine the correlation between the tension and the elongation of the web material.

Variator 5 suitably can be provided with a tension scale, by means of which it will be easy to adjust the variator in order to give the web material a certain tension level. The measurements can be repeated with frequent intervals, a continuous follow-up of the elongation being obtained, in order to directly correct deviations due to variations in the web thickness, moisture etc.

When the coefficient of elasticity of the web material is tested, measuring wheel 21 is brought into contact with the web material, the obtained measuring values being sent to computer 17 from pulse generator 22 in order to calibrate measuring roll 18.

Variator 5 can also be controlled by computer 17 and a feedback self-regulating system is then obtained, if computer 17 has been programmed to continuously and with relatively frequent intervals control and correct the elongation in the web.

Also, a plurality of tension increases and/or decreases is connection with every measuring sequence can be applied in order to obtain measuring data, which the computer can process in connection with a calculation of the residual elongation in those cases when a plastic elongation may occur, e.g. in connection with moisture during an offset-printing. However, in case variator 5 is also controlled by the computer, a continuous correction and control towards the desired elongation, if a linear tension-elongation-correlation is assumed, often can yield a sufficient accuracy.

The apparatus according to the invention need not have to include a computer. The necessary calculations can, starting from the read values, be done by the machine operator, who can graphicly estimate the tension $\sigma_t$, which ought to be set according to FIG. 2. Tension $\sigma_t$ can alternatively be calculated by using the formula, which directly gives the web tension, which is to be set. Also, the subsequent control of the elongation and/or the tension can be carried out by the operator.

I claim:

1. A method of controlling the elongation of a running web of printing material in a continuous printing apparatus having at least one infeed roll, at least one printing cylinder and at least one outfeed roll and wherein the running web is tensioned between the infeed roll and the outfeed roll, comprising the steps of:

(1) measuring said tension and a length of the running web between the infeed roll and the outfeed roll;

(2) immediately after step (1), accelerating or decelerating the running web by a selected amount so as to change said tension and length;

(3) measuring said change in tension and the change in length;

(4) determining a value of an elastic elongation of the running web as a function of said change in tension and said change in length; and (5) increasing or decreasing the tension of the running web as a function of the value of elastic elongation so as to control the elastic elongation of the running web.

2. A method according to claim 1, wherein the value of elastic elongation is periodically determined.

3. A method according to claim 1, wherein the change in tension is carried out through a velocity change of the running web.

4. A method according to claim 3, wherein the velocity change of the running web is carried out by means of braking roll, which is driven by a motor, or a brake, and wherein the running web tension is measured by a web tension meter.

5. A method according to claim 4, wherein the change in length is measured by means of a pulse counter disposed near at least one measuring roll, which measuring roll is equipped with a pulse generator.

6. A method according to claim 5, wherein the change in length and the change in tension measurements are transmitted to a computer, which calculates said value of elastic elongation.

7. A method according to claim 6, wherein the computer compares the determined values of the elastic elongation with a reference value of the elastic elongation and controls a tension regulation roll as a function of the comparison to reduce differences between the determined and reference values.

8. A method according to claim 1, wherein the acceleration or deceleration of the running web is applied between the printing cylinder and the outfeed rolls.

9. A method according to claim 5, wherein the acceleration or deceleration of the running web is applied between the outfeed rolls and the measuring roll.

* * * * *